US009010851B2

(12) United States Patent
LaPointe

(10) Patent No.: US 9,010,851 B2
(45) Date of Patent: Apr. 21, 2015

(54) FURNITURE MEMBER POWER MECHANISM WITH SELECTABLE LIFT MOVEMENT AND ZERO GRAVITY POSITION

(71) Applicant: La-Z-Boy Incorporated, Monroe, MI (US)

(72) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 14/031,446

(22) Filed: Sep. 19, 2013

(65) Prior Publication Data

US 2015/0076881 A1 Mar. 19, 2015

(51) Int. Cl.
*A47C 1/02* (2006.01)
*A47C 1/032* (2006.01)

(52) U.S. Cl.
CPC ..... *A47C 1/032* (2013.01)

(58) Field of Classification Search
USPC ..... 297/85 M, 330
See application file for complete search history.

(56) References Cited

U.S. PATENT DOCUMENTS 4,690,457 A 9/1987 Poncy et al.
4,752,101 A 6/1988 Yurchenco et al.
4,852,939 A 8/1989 Krauska
5,061,010 A 10/1991 LaPointe
5,222,286 A 6/1993 Saul et al.
5,265,935 A 11/1993 Geisler et al.
5,288,126 A 2/1994 Saul et al.
5,314,238 A 5/1994 Komorowski et al.
5,466,046 A 11/1995 Komorowski et al.
5,482,350 A 1/1996 Komorowski et al.
5,520,439 A 5/1996 Blount
5,524,303 A 6/1996 Palmer, Jr. et al.
5,651,580 A 7/1997 LaPointe et al.
5,730,494 A * 3/1998 LaPointe et al. ..... 297/85 M X
5,747,965 A 5/1998 LaPointe et al.
5,806,920 A 9/1998 Blount
5,992,931 A * 11/1999 LaPointe et al. ..... 297/85 M
6,338,531 B1 1/2002 Hausherr et al.
6,491,342 B1 12/2002 Smith
6,492,786 B1 12/2002 Vang et al.

(Continued)

FOREIGN PATENT DOCUMENTS

GB 2485434 A A 5/2012

OTHER PUBLICATIONS

International Search Report for PCT/US2012/052069 dated Feb. 19, 2013.

(Continued)

*Primary Examiner* — Rodney B White
(74) *Attorney, Agent, or Firm* — Harness, Dickey & Pierce, P.L.C.

(57) ABSTRACT

A furniture member mechanism includes a base frame. A first mechanism connected to the base frame includes a first motor connected to the base frame. A torque tube is connected to the first motor and is displaced by operation of the first motor. First and second rotation links are individually rotatably connected to the base frame and are connected to the torque tube. The first and second rotation links provide for rotation of the second mechanism to one of a rear tilt position or a forward lift position by operating the first motor displacing the torque tube.

20 Claims, 18 Drawing Sheets

(56) References Cited

U.S. PATENT DOCUMENTS

| | | | | |
|---|---|---|---|---|
| 6,659,556 | B2 | 12/2003 | Pellerin | |
| 6,794,841 | B1 | 9/2004 | Vang et al. | |
| 6,823,545 | B1 | 11/2004 | Davis | |
| 7,000,988 | B2 | 2/2006 | Bressler et al. | |
| 7,090,297 | B2 | 8/2006 | Mohn et al. | |
| 7,311,359 | B2 | 12/2007 | Smith | |
| 7,455,360 | B2 | 11/2008 | White et al. | |
| 7,600,817 | B2 | 10/2009 | Kramer et al. | |
| 7,722,114 | B2 | 5/2010 | Smith | |
| 7,766,421 | B2 | 8/2010 | Lawson | |
| 7,850,238 | B2 | 12/2010 | Erb et al. | |
| 8,419,122 | B2 * | 4/2013 | Lawson et al. | 297/85 M |
| 8,696,054 | B2 * | 4/2014 | Crum | 297/85 M |
| 2011/0181094 | A1 * | 7/2011 | Lawson et al. | 297/85 R X |

OTHER PUBLICATIONS

Written Opinion of the International Searching Authority for PCT/US2012/052069 mailed Feb. 19, 2013.

* cited by examiner

FURNITURE MEMBER POWER MECHANISM WITH SELECTABLE LIFT MOVEMENT AND ZERO GRAVITY POSITION

FIELD

The present disclosure relates to power lift furniture members having power mechanisms to move components of the furniture member.

BACKGROUND

This section provides background information related to the present disclosure which is not necessarily prior art.

Furniture members such as recliners, sofas, love seats, and ottomans commonly provide a structural frame supporting a body which allows the body to displace forwardly from an upright or seated operating position to a lift position which raises an occupant of the furniture member to an elevated position approximating a standing position. The lift mechanism is powered to assist the occupant who may not be able to stand effectively from the furniture member normal upright position. Known mechanisms allowing such lift travel during do not however also permit a rearward tilt motion of the body to a zero gravity position while still maintaining wall clearance at all seat back member positions.

SUMMARY

This section provides a general summary of the disclosure, and is not a comprehensive disclosure of its full scope or all of its features.

According to several aspects, a furniture member having a mechanism selectable for each of a rearward tilt and a forward lift operation includes a base frame supporting the furniture member on a floor surface. A first mechanism connected to the base frame includes a first motor connected to the base frame. A torque tube is connected to the first motor and is displaced by operation of the first motor. First and second rotation links are individually rotatably connected to the base frame and are connected to the torque tube. The first and second rotation links provide for rotation of the second mechanism to one of a rear tilt position and a forward lift position by operating the first motor displacing the torque tube.

According to further aspects, a furniture member, includes a base frame supporting the furniture member on a floor surface. A first mechanism rotatably connected to the base frame includes a first motor rotatably connected to the base frame. A torque tube is connected to the first motor by an extension tube. The extension tube is axially displaced by operation of the first motor. A pivot tube is connected by side frame members to the torque tube and is connected by first and second journal bearings to the base frame. A furniture member base member is connected to the side frame members and rotated together with the second mechanism by operation of the first motor to one of a rear tilt position and a forward lift position by operation of the first motor.

According to still further aspects, a furniture member mechanism providing rearward tilt and forward lift operations includes a base frame supporting the furniture member on a floor surface. A first mechanism connected to the base frame includes a first motor movably connected to the base frame. A torque tube connected to an extension tube displaced by operation of the first motor. A pivot tube is connected to the first mechanism and connected by first and second journal bearings to the base frame. A second mechanism is supported and rotated by the first mechanism. The second mechanism includes a second motor. First and second rotation links are individually rotatably connected to the base frame and are connected to the torque tube. The first and second rotation links provide for rotation of the second mechanism to one of a rear tilt position having the pivot tube positioned below the torque tube and a forward lift position having the pivot tube positioned above the torque tube by operation of the first motor displacing the torque tube.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
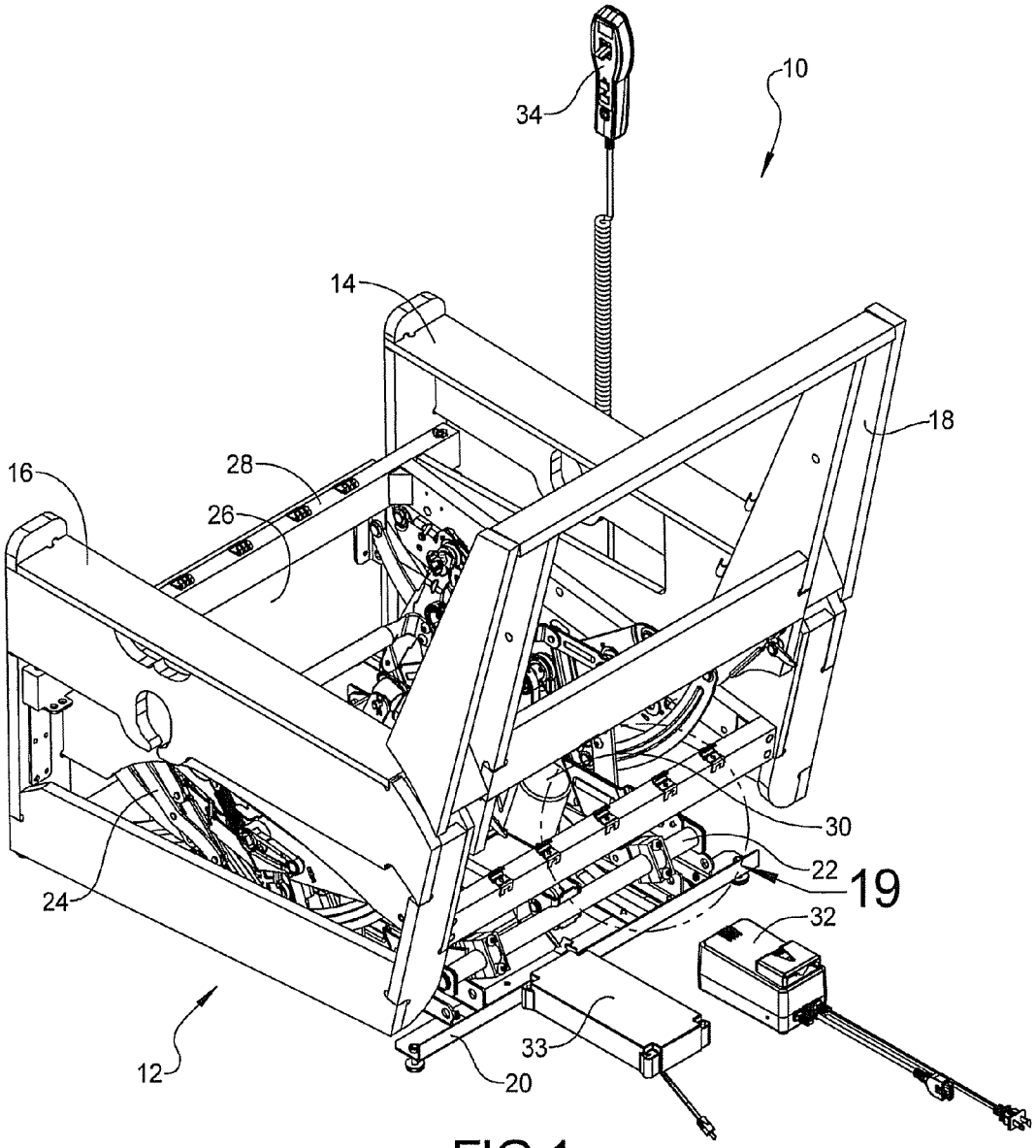
FIG. 1 is a rear perspective view looking forward of a furniture member power mechanism with zero gravity and rear tilt positions.

Referring to FIG. 1, a furniture member 10, which is depicted as a rocking reclining chair, includes a base member 12 which defines a frame, for example, made of wood or a combination of wood and composite materials that includes each of a first arm rest member 14, defining a right side of furniture member 10 with respect to an occupant seated in the furniture member, and a second armrest member 16, defining a left side. A seat back member 18 is rotatably disposed with respect to the base member 12. The base member 12 and the seat back member 18 are supported on a base frame 20 which can be made, for example, from wood and/or from metal, and according to aspects shown is created of metal "L-shaped" members fastened to each other. The base member 12 is rotatable with respect to base frame 20, and can further both tilt and be forwardly displaced by motion with respect to a pivot tube 22. Pivot tube 22 is located proximate to a rear cross member portion of the base frame 20.

To support the legs of an occupant of furniture member 10, a leg rest linkage assembly 24 is disposed within the base member 12 and is operated to extend or retract a leg rest member 26, shown in a retracted or stowed position. The leg rest linkage assembly 24 in the leg rest stowed position is positioned below a seat frame 28 which connectively joins the first and second arm rest members 14, 16. A tilt function of furniture member 10, which will be described in greater detail in reference to FIGS. 4-5, rotates and displaces base member 12 by motion of pivot tube 22, is directed by actuation of a tilt and lift first motor 30, which is also positioned within base member 12 and is connected to the base frame 20. According to several aspects, first motor 30 is a DC electrical motor. Power to energize first motor 30 is provided via a power converter 32 which can be plugged into a household electrical outlet. Power converter 32 converts household 115 VAC electrical power to DC electrical power for use by first motor 30. A controller 33 is also provided which assists in operation at a lift position shown and described in reference to FIGS. 12-15. For independent operation of the various motions of furniture member 10, a control device 34, such as a handheld switching device, is provided.

Referring to FIG. 2 and again to FIG. 1, the furniture member 10 is shown in an upright position having the leg rest member 26 at its stowed position and the seat back member 18 in a fully upright position, which is reached by rotation of the seat back member 18 with respect to a forward rotation direction "A". The base frame 20 further includes extended support legs 35, 35' (only the right side support leg 35 is clearly visible in this view) and opposed side frame members 36, 36' (only one of which is visible in this view) each of which is further provided with one of a plurality of height adjustable support feet 38 which allow the orientation of base frame 20 and therefore furniture member 10 to be adjusted with respect to a floor surface 40. In the furniture member upright position, a rearmost point 42 of furniture member 10, defined as an upper rear corner of the seat back member 18, is positioned with respect to a plane 44 which is spaced from a wall surface 46 defining a nominal wall clearance dimension (WCnom) which allows clearance for upholstery (not shown) and for subsequent rotation and movement of the seat back member 18 during the various operating modes of furniture member 10.

Figure 2:
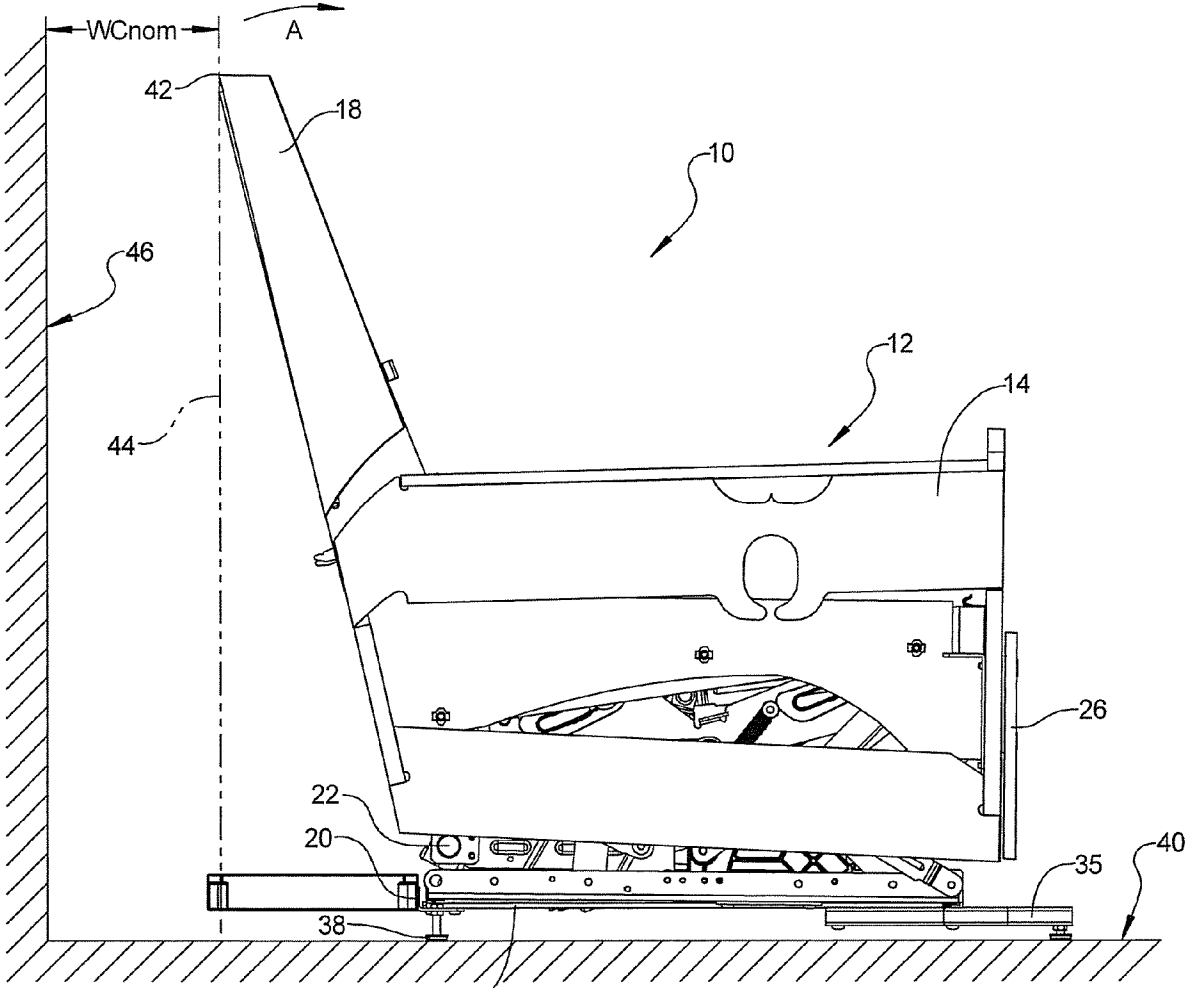
FIG. 2 is a right side elevational view of the furniture member of FIG. 1.

Referring to FIG. 3 and again to FIGS. 1 and 2, components associated with the tilt operation define a first mechanism 47 that includes first motor 30 and each of a drive housing 48 which directly supports the first motor 30, a shaft housing 50 directly connected to the drive housing 48, and an extension shaft 52 extensible and retractable from shaft housing 50, which is shown in its fully retracted position and positioned therefore substantially within the shaft housing 50. The extension shaft 52 is connected to a coupling end 54 whose function will be better described in reference to FIG. 4. According to several aspects, the first motor 30 and the associated components of first mechanism 47 are positioned to one side of a lateral centerline 55 of furniture member 10 and are connected in part to and supported on the base frame 20.

The side positioning of the first motor 30 and first mechanism 47 with respect to lateral centerline 55 provides space between first and second armrest members 14, 16 for a centralized position of a drive or second mechanism 57. Second mechanism 57 includes a drive or second motor 56 which is responsible for extension and retraction of the leg rest member 26 as well as rotation of the seat back member 18. The components of second mechanism 57 are connected to and therefore displace during motion directed by the first mechanism 47. The second motor 56 also a DC electric motor and is directly connected to a drive housing 58. A slide assembly 60 is slidably disposed on a slide frame 62 which is operably coupled to the drive housing 58. A gear assembly, such as a worm gear (not shown), provided within the slide frame 62 causes an axial, sliding displacement of the slide assembly 60 during operation of second motor 56. Second motor 56 can be operated at the same time as first motor 30 or can be operated separately from first motor 30. The slide assembly 60 is connected to and displaces each of a leg rest linkage assembly **24*a* and a leg rest linkage assembly 24*b*, defining right hand and left hand portions of the leg rest linkage assembly 24. The second motor 56 is rotatably coupled to pivot tube 22 using a pivot mount 64 to allow for rotation of second motor 56 during the various operating modes of furniture member 10**.

Figure 3:
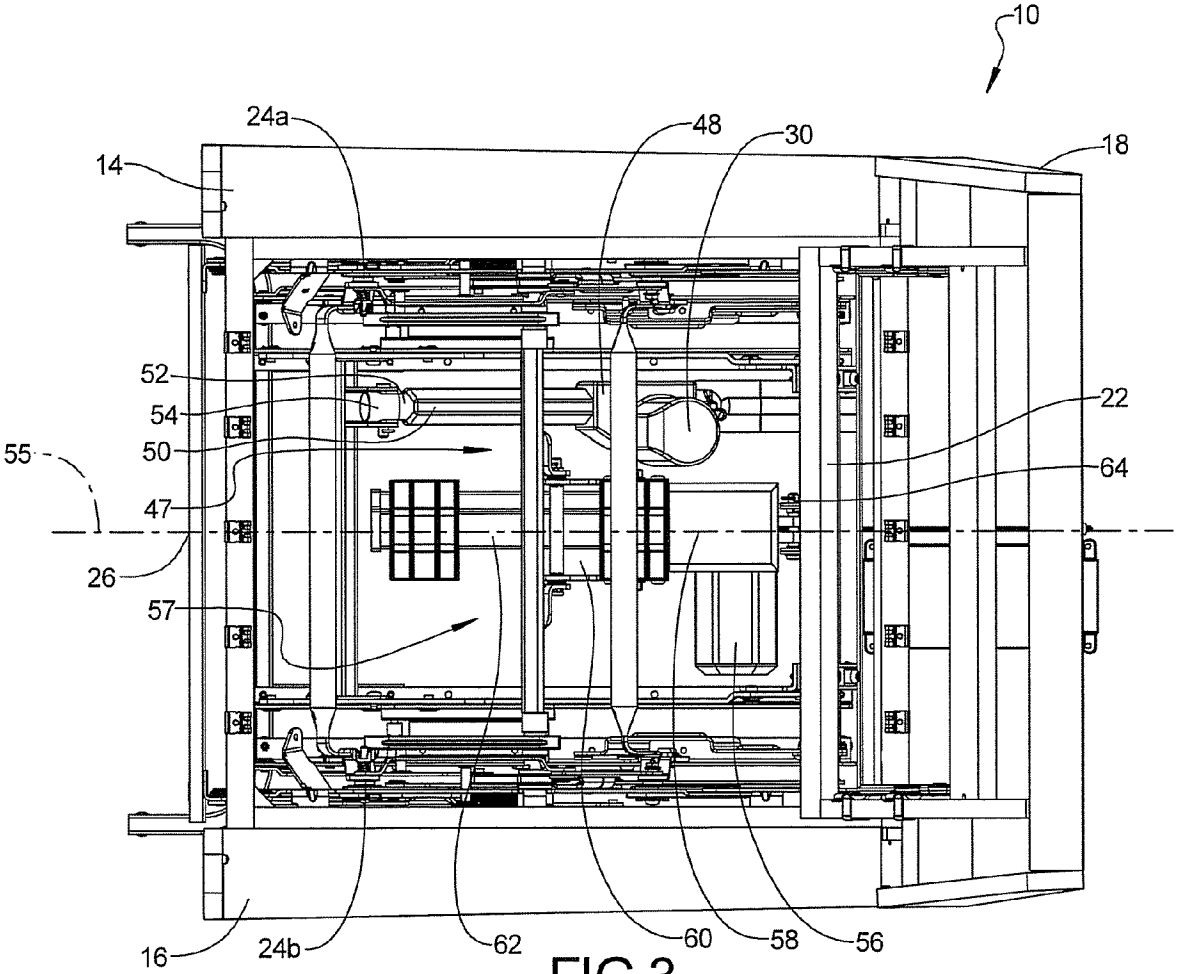
FIG. 3 is a top plan view of the furniture member of FIG. 1.

Referring to FIG. 4 and again to FIGS. 1-3, furniture member 10 is shown following operation of the components of first mechanism 47 including first motor 30, which repositions the furniture member 10 away from the upright position, shown with respect to FIGS. 1-3, to a rear tilt position shown. Operation of first motor 30 causes axial forward extension of extension shaft 52 which is rotatably connected to a coupling bracket 66 which is connected to base frame 20. During tilt operation mode, axial extension of extension shaft 52 causes base member 12 to displace in a forward displacement direction "B" with respect to the base frame 20. Base member 12 also rearwardly tilts in a rearward rotational arc "C" by operation of first motor 30. A rear tilt position shown has the pivot tube 22 positioned below a torque tube 122, 124 (shown and described in reference to FIGS. 15-16).

In order to couple the pivot tube 22 to the base frame 20, a first journal bearing 68 and a second journal bearing 70 are fastened to the pivot tube 22. Each of the first and second journal bearings 68, 70 are connected using a first journal link 72 and a second journal link 74, respectively, to individual ones of a first link connecting plate 76 and a second link connecting plate 78. The first link connecting plate 76 is fixed to a first L-shaped frame member 80 of base frame 20. Similarly, the second link connecting plate 78 is fixed to a second L-shaped frame member 82 of base frame 20. The use of the first and second journal bearings 68, 70 permits the pivot tube 22 to both axially rotate (providing for the tilt motion) and longitudinally displace (providing displacement in forward displacement direction "B") during operation of first motor 30, which will be described in greater detail in reference to FIGS. 14-17.

Figure 4:
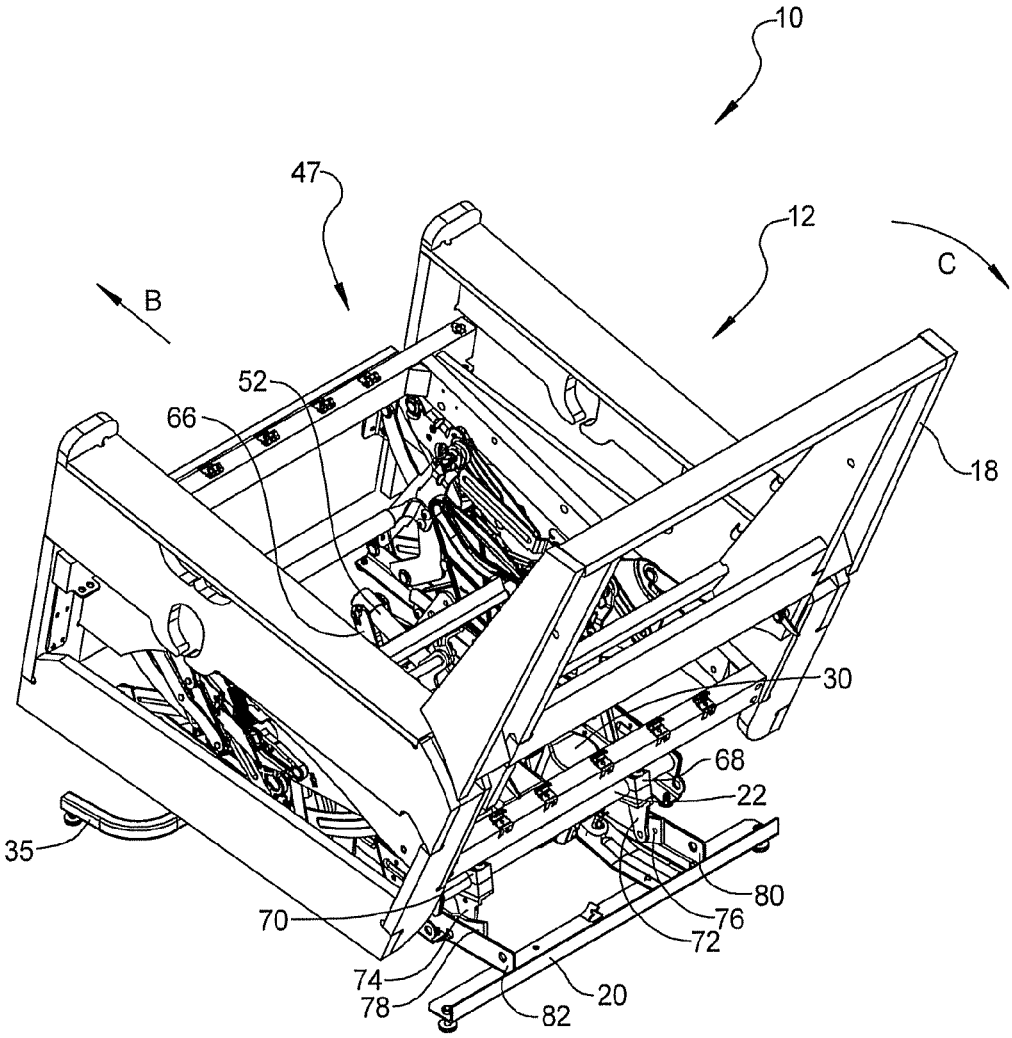
FIG. 4 is a rear perspective view looking forward of the furniture member of FIG. 1 repositioned to a rear tilt position.

Referring to FIG. 5 and again to FIGS. 2 and 4, as base member 12 rotates rearwardly with respect to the rearward rotational arc "C" during operation of first motor 30, the seat back member 18 is retained in its fully upright position. Because base member 12 can displace forwardly in the forward displacement direction "B" at the same time that tilt rotation is occurring, the rearmost point 42 does not substantially displace closer to the wall surface 46, thereby providing a wall clearance dimension $WC_1$ which is substantially unchanged from the wall clearance nominal dimension WCnom shown with respect to FIG. 2. To achieve the tilt position of base member 12, operation of first motor 30 causes rotation of a first rotation link 84 (a second rotation link 84' positioned on the left side is not clearly visible in this view) which rotates with respect to a first rotational fastener 86 connected to the first L-shaped frame member 80. The forward rotation of the first rotation link 84 changes an orientation of a base member lower surface 88 of base member 12, which raises a base member lower front corner 90 above a base member lower rear corner 92. This orientation of base member lower surface 88 creates an angle of rotation or first tilt angle alpha ($\alpha$) between the base member lower surface 88 and the floor surface 40. As previously noted, during tilt operation, the pivot tube 22 will also displace generally in the forward displacement direction "B". This also helps ensure that the wall clearance $WC_1$ between the furniture member and wall surface 46 is substantially unchanged from wall clearance WCnom.

Figure 5:
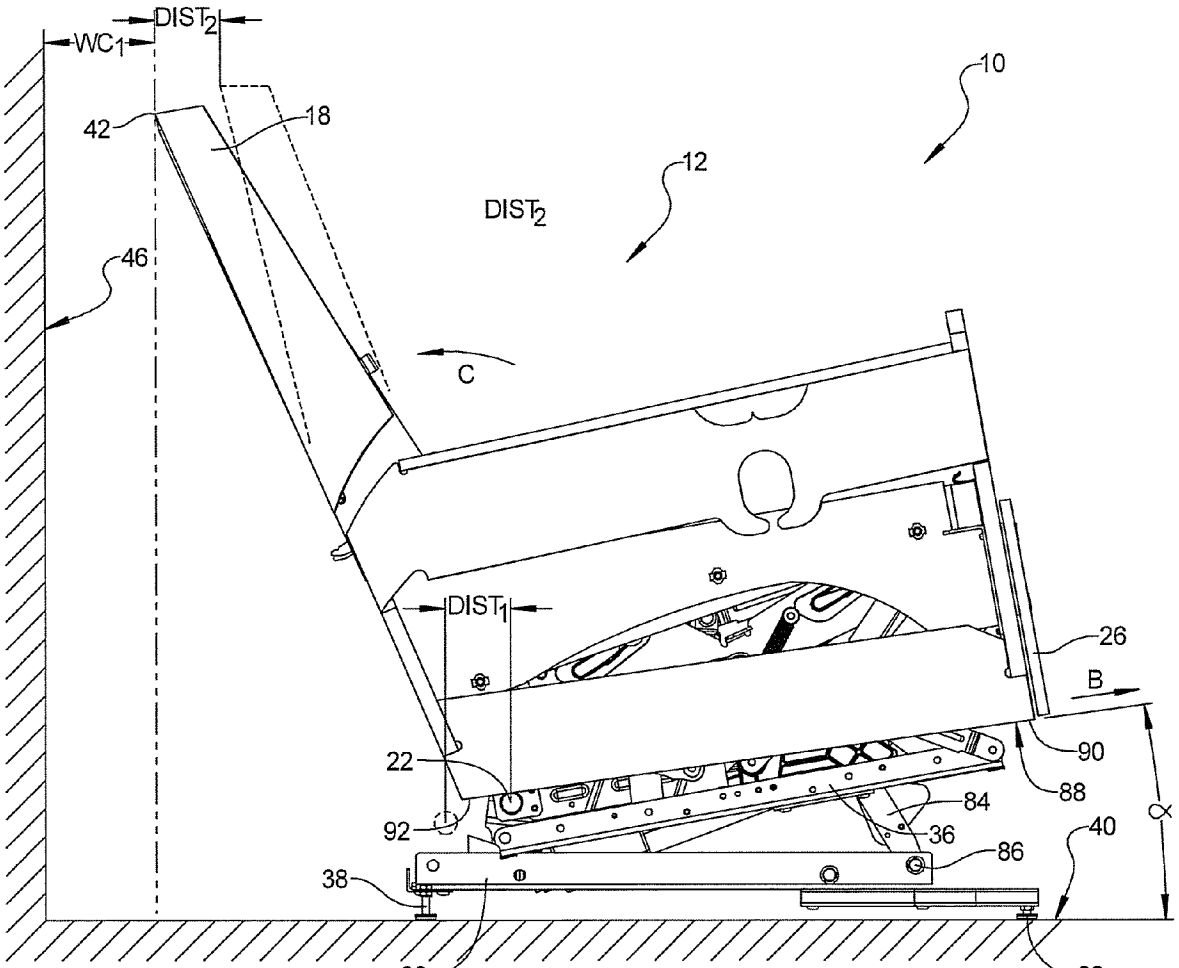
FIG. 5 is a right side elevational view of the furniture member at the rear tilt position of FIG. 4.

As further shown in FIG. 5, a first distance "$Dist_1$" of forward displacement of the pivot tube 22 during operation of the first motor 30 is substantially equal to a second distance "$Dist_2$". Second distance "$Dist_2$" is defined as the rearward displacement of the rearmost point 42 of seat back member 18 of the furniture member 10 connected to the base member 12 due to rearward rotation of the furniture member 10 during rotation to the rear tilt position. Because first distance "$Dist_1$" substantially equals second distance "$Dist_2$" clearance (wall clearance $WC_1$) between the rearmost point 42 and the wall surface 46 proximate to the furniture member is retained between the upright position of the furniture member shown in FIG. 2 (having wall clearance WCnom) and the rear tilt position (having wall clearance $WC_1$) of the furniture member.

Referring to FIG. 6 and again to FIG. 5, with the furniture member 10 positioned in the tilt position, the occupant can select operation of second motor 56 which, when actuated, slidably displaces the slide assembly 60 forward, as previously described. The slide assembly 60 is linked using a rotational bracket assembly 94 to a drive rod 96. Opposite ends of drive rod 96 are slidably positioned in opposed V-shaped slots 98 (only a right hand V-shaped slot 98 is visible in this view). The V-shaped slots 98 are created in a first wall member 100 connected to each of the first and second armrest members 14, 16 of furniture member 10. As the rotational bracket assembly 94 displaces with respect to forward motion of the slide assembly 60, the drive rod 96 is repositioned from a rear end of the V-shaped slot 98 to a central lower position of V-shaped slot 98 shown. During this translation of drive rod 96 within V-shaped slot 98, each of the leg rest linkage assemblies 24*a*, 24*b* forwardly and outwardly extend in a leg rest extension direction "D", repositioning the leg rest member 26 from the stowed to a fully extended position shown. It is noted that the leg rest member 26 fully extended position is available in the furniture member tilt position shown.

Figure 6:
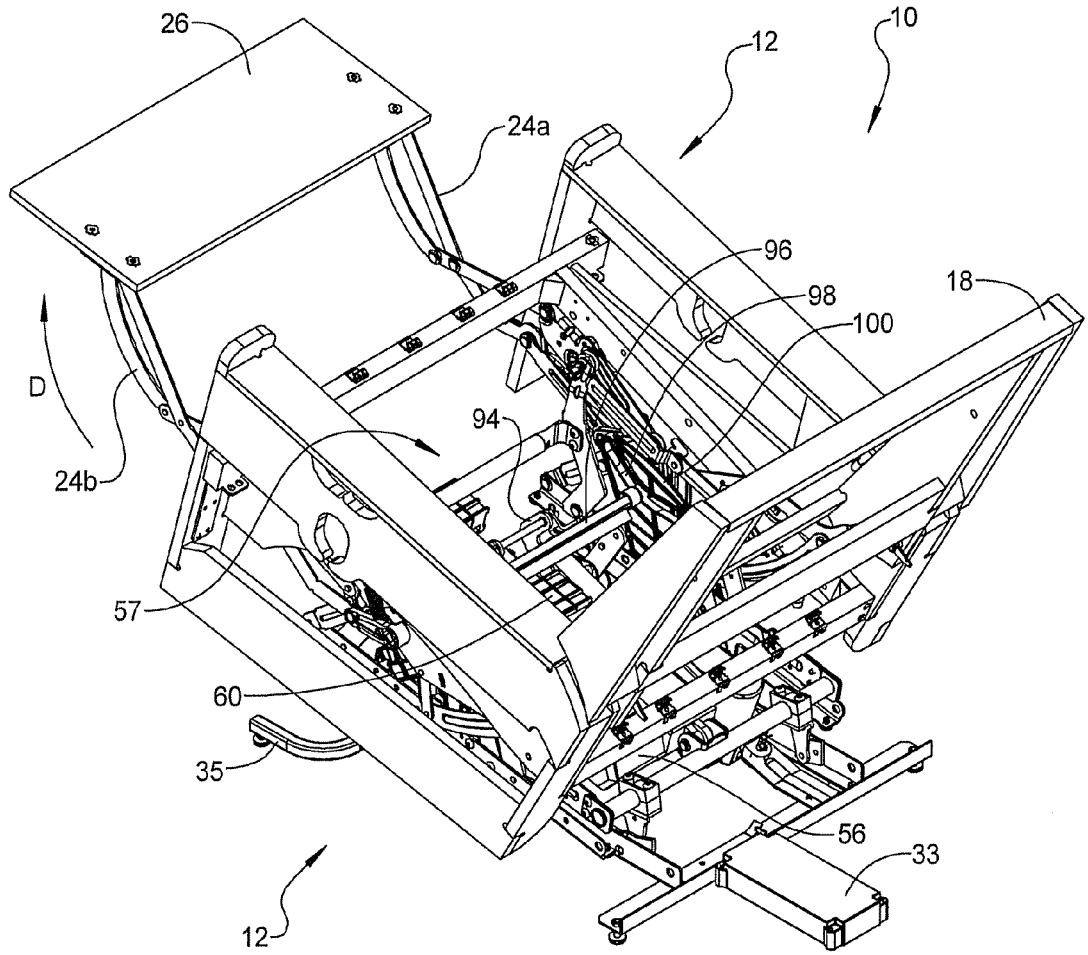
FIG. 6 is a rear perspective view looking forward of the furniture member rear tilt position of FIG. 4 further showing a leg rest assembly fully extended position.
Figure 7:
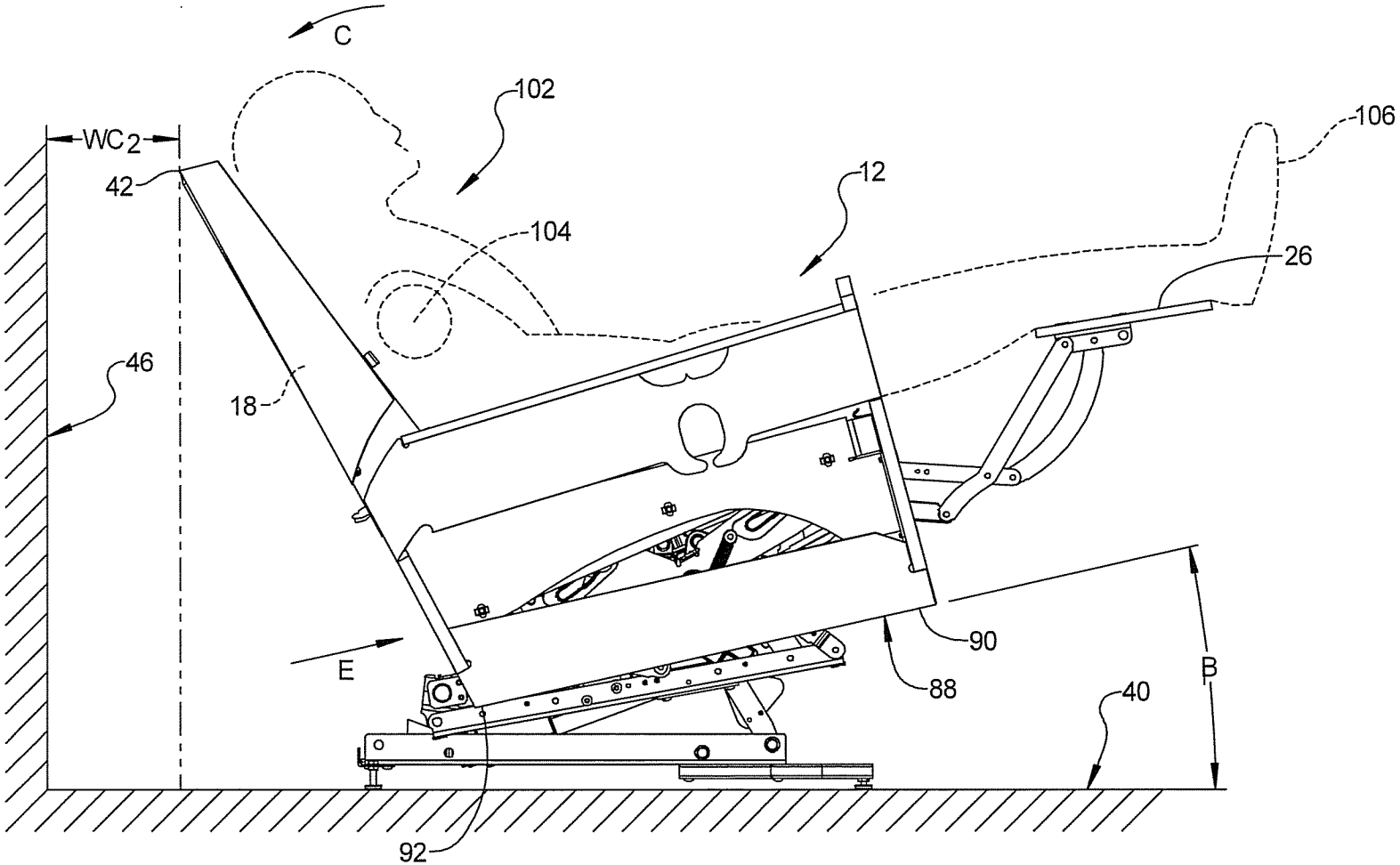
FIG. 7 is a right side elevational view of the furniture member at the rear tilt and leg rest fully extended position of FIG. 6.

Referring to FIG. 7 and again to FIGS. 5 and 6, additional displacement of the base member 12 in a forward elevation/extension direction "E" occurs during leg rest extension. Because the seat back member 18 is retained in its fully upright position during this operation, a wall clearance dimension $WC_2$ is defined when the base member 12 reaches the tilt position and the leg rest member 26 is positioned in its fully extended position. As the leg rest member 26 reaches the fully extended position, the base member lower surface 88 creates a second tilt angle $\beta$ (beta) with respect to the floor surface 40. According to several aspects, second tilt angle $\beta$ (beta) is greater than first tilt angle $\alpha$ (alpha) which is provided during seat tilt only. The additional seat tilt provided at the achieved position of second tilt angle $\beta$ (beta) helps to position an occupant 102 of furniture member 10 such that a heart elevation 104 of the occupant 102 is positioned substantially level with or below a foot elevation 106 of the occupant 102. As shown in FIG. 7, the base member lower front corner 90 is additionally elevated with respect to the base member lower rear corner 92. In addition, base member lower rear corner 92 is further lowered in elevation with respect to the first tilt position shown and described in reference to FIG. 5.

Referring to FIG. 8 and again to FIGS. 6 and 7, as previously noted operation of second motor 56 causes forward displacement of the slide assembly 60 in a slide displacement direction "F". A corresponding forward displacement of the drive rod 96 simultaneously occurs with the forward displacement of slide assembly 60. Operation of the second motor 56 can be stopped when the leg rest member 26 reaches its fully extended position shown.

Figure 8:
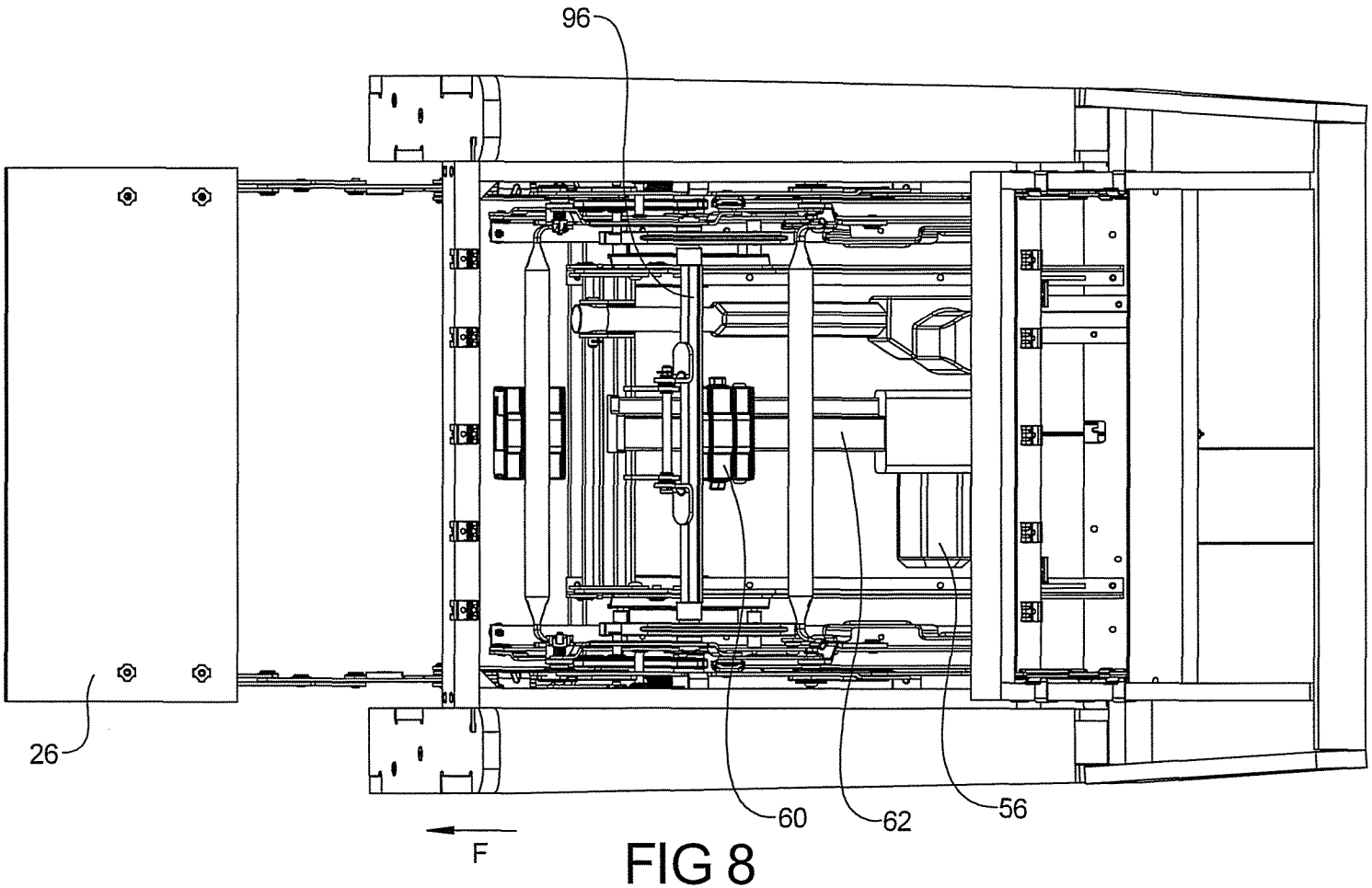
FIG. 8 is a top plan view of the furniture member of FIG. 6.
Figure 9:
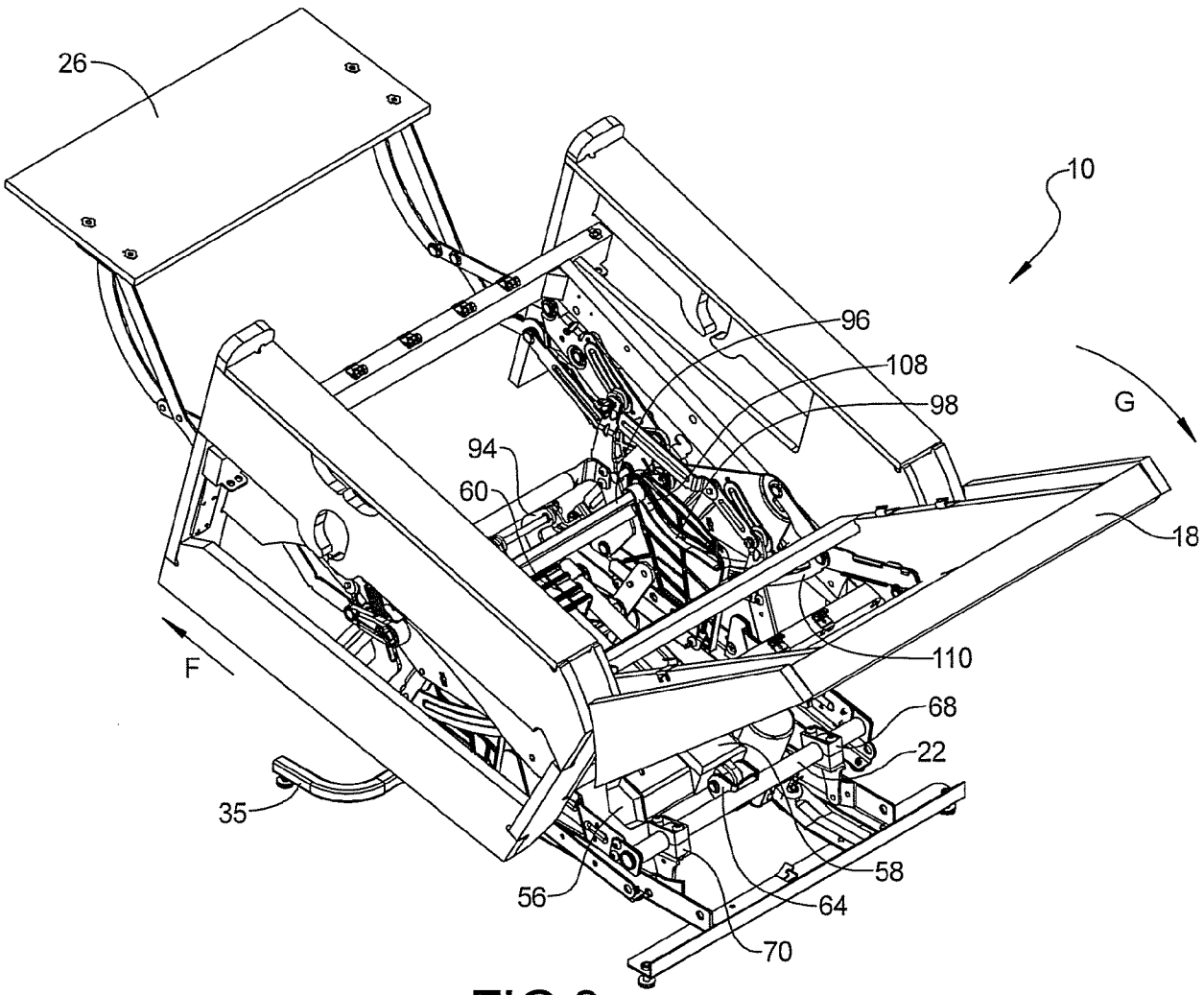
FIG. 9 is a rear perspective view looking forward of the furniture member rear tilt and leg rest fully extended position of FIG. 6 further showing a seat back fully reclined position.

Referring to FIG. 9 and again to FIGS. 6-8, if the occupant continues to operate the second motor 56 after leg rest member 26 reaches its fully extended position, continued forward sliding displacement of slide assembly 60 causes displacement of the rotational bracket assembly 94, thereby further forwardly displacing the drive rod 96 until drive rod 96 reaches a forward slot end 108 of V-shaped slot 98. During the continued forward translation of drive rod 96 within the V-shaped slot 98, the forward displacement of drive rod 96 causes a rearward rotation of the seat back member 18 with respect to a seat back recline direction "G". Seat back member 18 recline is directed by displacement of an arc link 110, 110' positioned on opposite right and left hand sides of furniture member 10. Rearward rotation of the seat back member 18 to a fully reclined positioned shown is achieved when the drive rod 96 contacts the forward slot end 108. Some rotation of the first and second journal bearings 68, 70 also occurs during the displacement of leg rest member 26, which is permitted by the rotational connection between drive housing 58 and pivot tube 22 using the pivot mount 64. Additional rotation of each of the first and second journal bearings 68, 70 also occurs during the rotation of seat back member 18.

Figure 10:
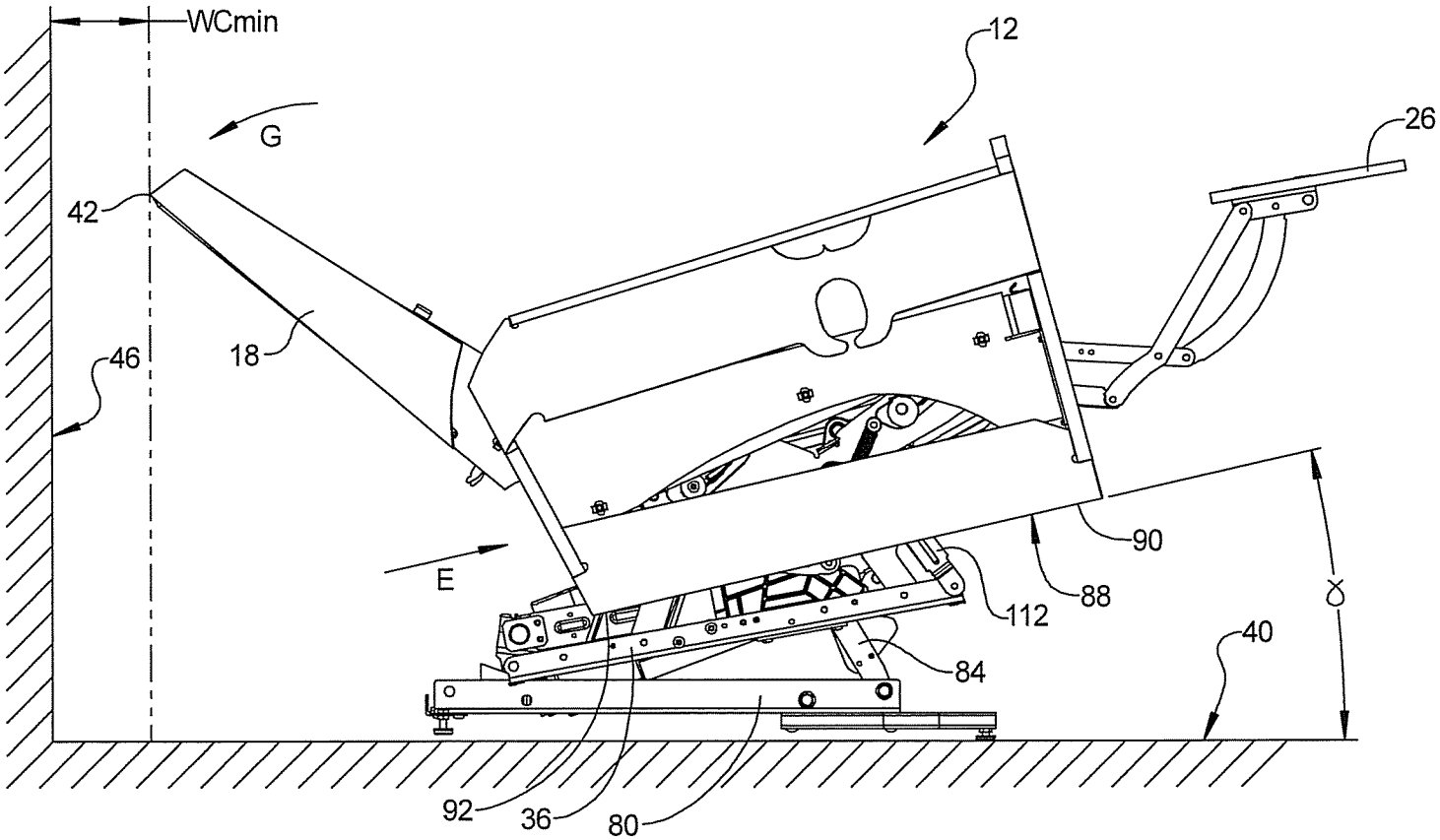
FIG. 10 is a right side elevational view of the furniture member of FIG. 9.

Referring to FIG. 10 and again to FIGS. 1-9, the rearward rotation of seat back member 18 to its fully reclined position shown by rotation with respect to the seat back recline direction "G" positions rearmost point 42 of seat back member 18 at its closest point of approach to wall surface 46, defined as wall clearance WC minimum with respect to wall surface 46. WC minimum is predetermined to provide sufficient clearance for upholstery which is commonly provided on seat back member 18 such that the upholstery also does not contact wall surface 46 at the fully reclined position of seat back member 18. As the seat back member 18 reclines, additional displacement of base member 12 occurs in the forward elevation/ extension direction "E". This additional forward extension causes rotation of a second rotation link 112 (a left hand second rotation link 112' is not clearly visible in this view). Second rotation link 112 is rotatably connected to the first L-shaped frame member 80. Due to the forward rotation of second rotation link 112, the base member lower surface 88 is additionally elevated and angled at a third tilt angle γ (gamma) with respect to the floor surface 40 when seat back member 18 reaches the fully reclined position. According to several aspects, third tilt angle γ (gamma) is greater than each of angle β (beta) and angle α (alpha) previously described herein. It is further noted that the base member lower rear corner 92, as well as the base member lower front corner 90, are both additionally elevated with respect to the seat back fully extended position and/or the tilt position of base member 12 previously described herein.

Figure 11:
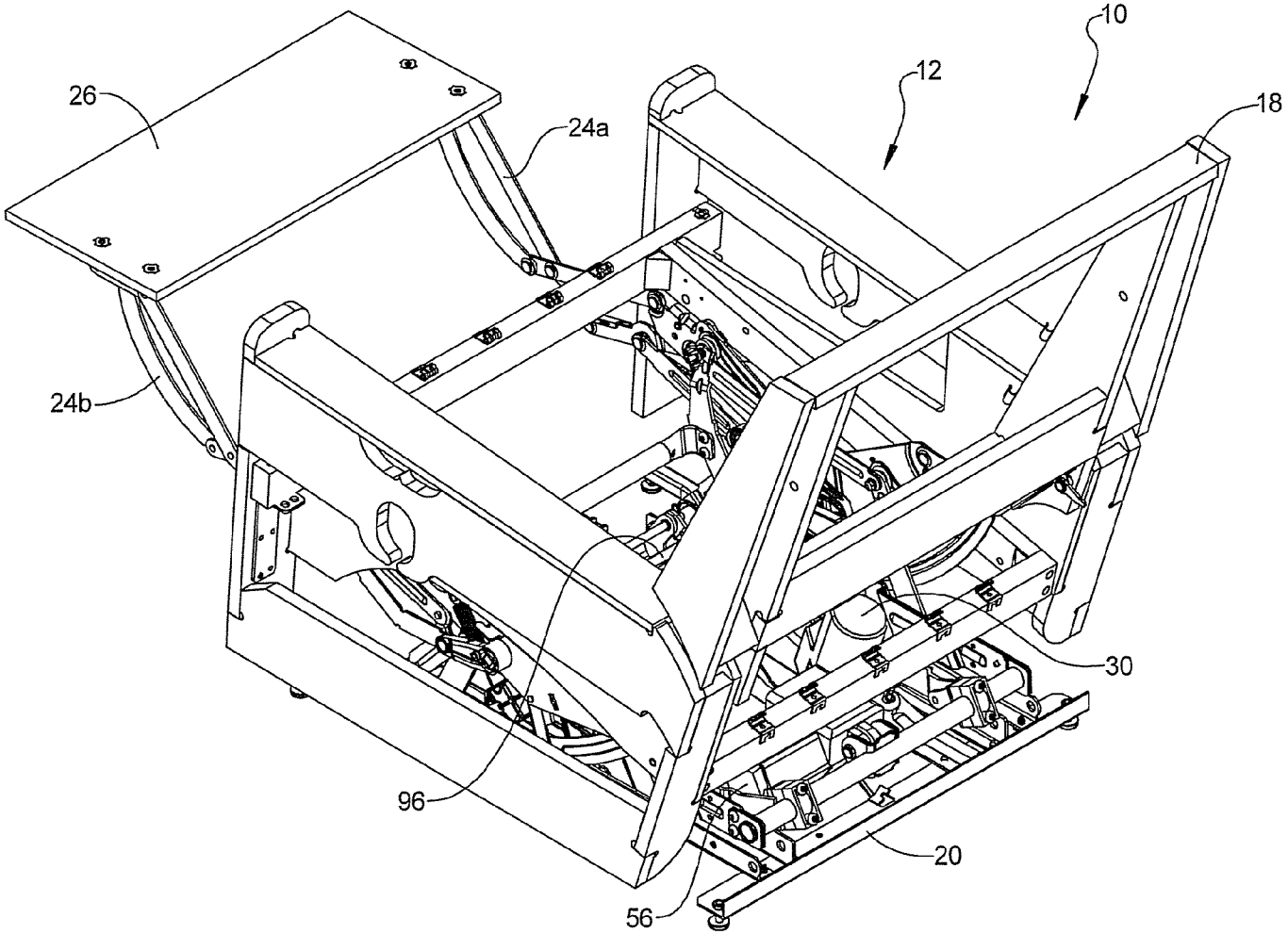
FIG. 11 is a rear perspective view looking forward of the furniture member of FIG. 1, further showing a leg rest fully extended position.

Referring to FIG. 11 and again to FIG. 1, prior to achieving any tilt position of base member 12 with respect to base frame 20, the leg rest member 26 can be extended from its stowed position to the fully extended position shown by operation of second motor 56 alone, and therefore without operation of first motor 30. With the base member 12 in its fully upright position, operation of second motor 56, as previously described, will cause forward displacement of the drive rod 96, thereby extending both of the leg rest linkage assemblies 24*a*, 24*b*. The occupant can therefore select full extension of leg rest member 26 without requiring any tilt position of base member 12.

Referring to FIG. 12 and again to FIGS. 1-4, by modifying first mechanism 47, furniture member 10 can separately be operated as a lift chair. In a lift mode of operation, actuation of first motor 30 causes a forward rotation of base member 12 in a lift rotation direction "H" in lieu of providing the rearward tilt motion previously described. The first and second rotation links 84, 84' are individually rotatably connected to the first and second L-shaped frame members 80, 82 using first and second rotational fasteners 114, 114' (only second rotational fastener 114' is clearly visible in this view). In lift chair mode, the base member 12 rotates with respect to an axis of rotation 116 defined through the central axes of first and second rotational fasteners 114, 114'. The lift chair mode thereby provides lifting support to help the occupant reach a near standing position to exit furniture member 10. During operation in lift chair mode, the leg rest linkage assembly 24 is prevented from extending away from the stowed position by preventing operation of second motor 56 by lockout programming provided in controller 33. The first and second link connecting plates 76, 78 together with the first and second rotation links 84, 84' provide rotational support for base member 12. The first and second link connecting plates 76, 78 are connected at rear ends to the first and second journal bearings 68, 70, and at forward ends using third and fourth rotational fasteners 118, 118' (only fourth rotational fastener 118' is visible in this view) which rotatably connect to each of the first and second L-shaped frame members 80, 82 at positions rearward of the first and second rotational fasteners 114, 114'.

Figure 12:
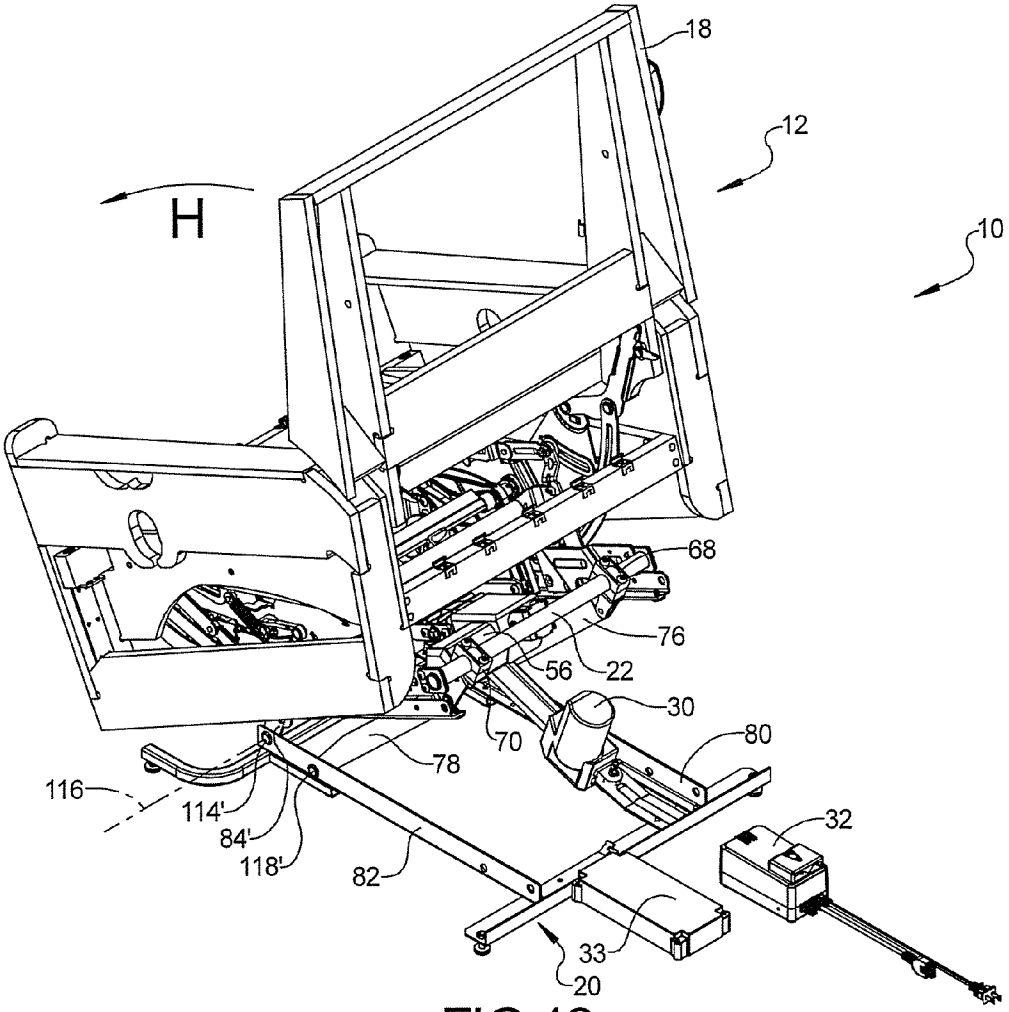
FIG. 12 is a rear perspective view looking forward of the furniture member of FIG. 1, further showing a full forward lift position.
Figure 13:
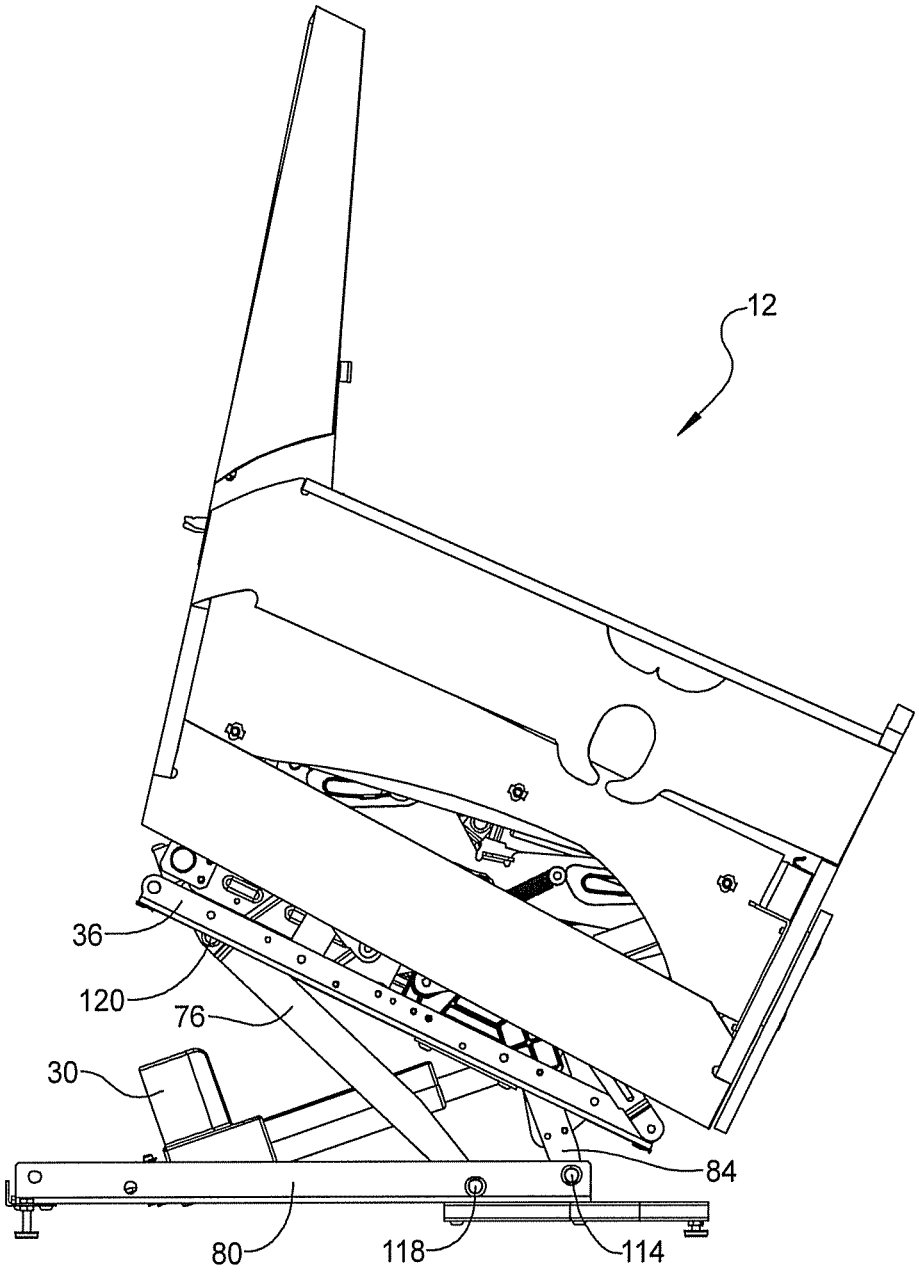
FIG. 13 is a right side elevational view of the furniture member of FIG. 12.

Referring to FIG. 13 and again to FIG. 12, at the lift position of furniture member 10 the side frame members 36, 36' (only side frame member 36 is visible in this view) are oppositely oriented than the orientation during chair tilt. A rear axis of rotation 120 is defined where the first and second link connecting plates 76, 78 are rotatably connected to the side frame members 36, 36'.

Figure 14:
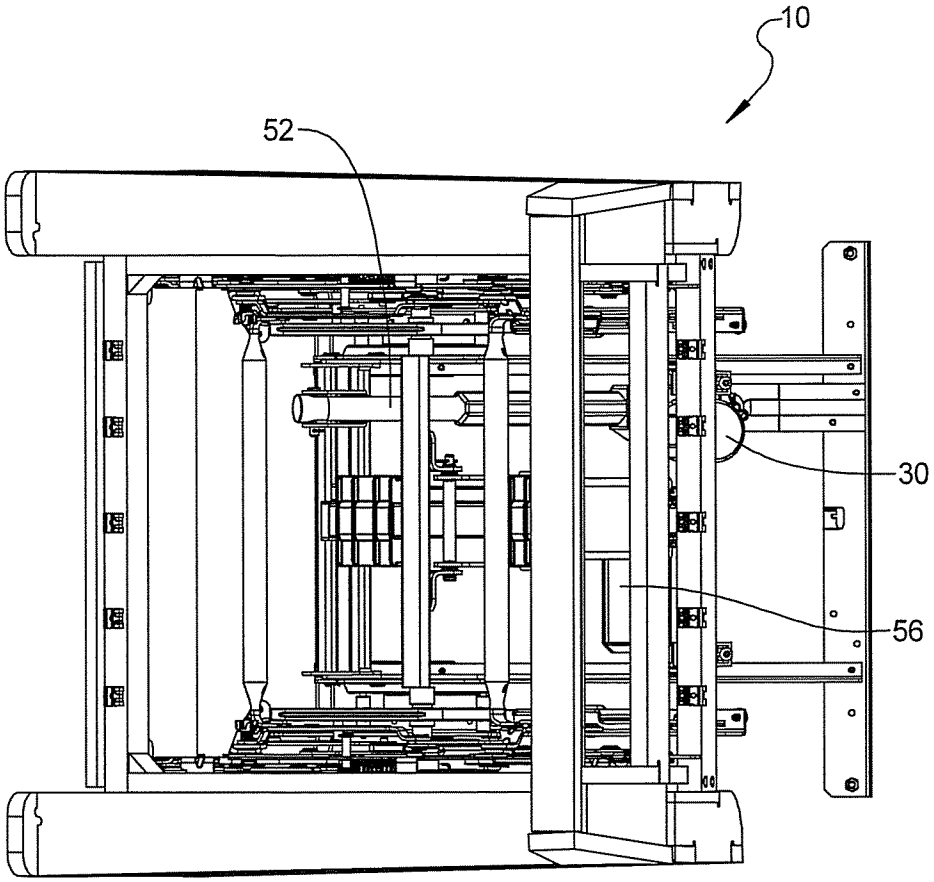
FIG. 14 is a top plan view of the furniture member of FIG. 12.

Referring to FIG. 14, during lift operating mode, operation of first motor 30 stops when full forward displacement of extension shaft 52 is reached. As previously noted, second motor 56 is prevented from operation during lift operating mode.

Referring to FIG. 15 and again to FIG. 4, first mechanism 47 is shown following operation of first motor 30 to achieve the rear tilt position described with reference to FIG. 4. During operation of first motor 30, as the extension shaft 52 axially extends from shaft housing 50, the coupling bracket 66 is induced to rotate forwardly, thereby displacing first and second torque tubes 122, 124 which are coupled to the first rotation links 84, 84'. First and second mount brackets are connected to the first rotation links 84, 84' and define an extent of the first mechanism 47, such that first mechanism 47 creates a first support portion of furniture member 10. Forward rotation of the first rotation links 84, 84' causes each of the first and second journal bearings 68, 70 to also forwardly rotate. Because the length of first rotation link 84, 84' is greater than a length of the first and second journal links 72, 74, the first and second torque tubes 122, 124 elevate to a greater degree than the pivot tube 22. The rotation of first and second journal links 72, 74 during tilt rotation mode is provided by use of a journal rotational fastener connecting each to its respective first or second link connecting plate 76, 78.

Figure 15:
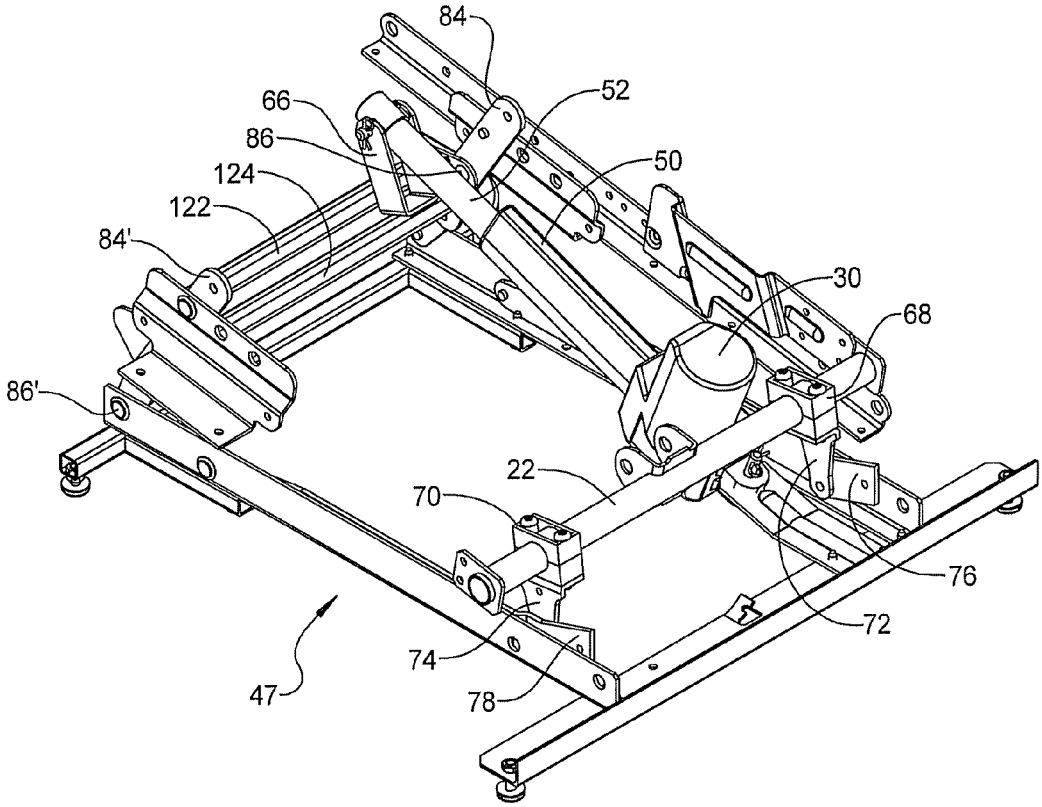
FIG. 15 is a rear perspective view looking forward of the mechanism assembly at the furniture member position of FIG. 4.
Figure 16:
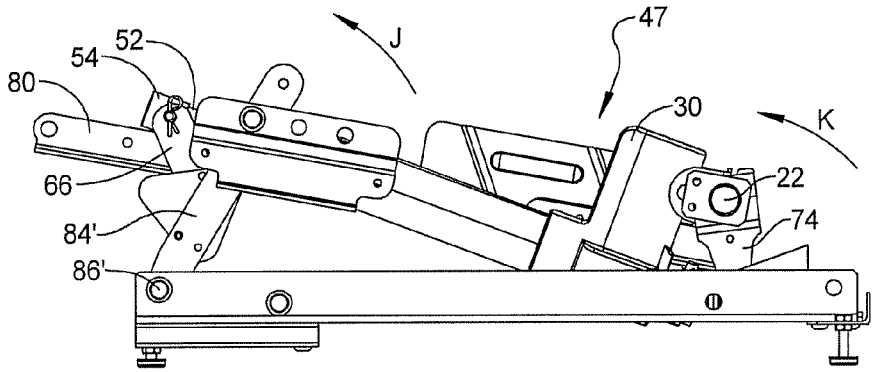
FIG. 16 is a left side elevational view of the mechanism assembly of FIG. 15.

Referring to FIG. 16 and again to FIGS. 4 and 15, as previously described, the outward extension of extension shaft 52 causes forward rotation of first rotation links 84, 84' with respect to first rotational fasteners 86, 86', causing the first rotation links 84, 84' to rotate with respect to a link arc of rotation "J". Similarly, each of the first and second journal links 72, 74 (only second journal link 74 is clearly visible in this view) rotate with respect to a journal arc of rotation "K", which according to several aspects has an arc length shorter than a length of the arc length of link arc of rotation "J". The first rotation links 84, 84' are longer than the first and second journal links 72, 74, which provides the rear tilt position having the pivot tube 22 positioned below the first and second torque tubes 122, 124.

Referring to FIG. 17 and again to FIGS. 1-3 and 15-16, the forward lift position of first mechanism is shown. As previously noted, components of first mechanism 47 include first motor 30, drive housing 48, shaft housing 50, extension shaft 52, and coupling end 54. The components of first mechanism 47 are connected to a rear frame member 121 of base frame 20 at a rear end (to the right as viewed in FIG. 17) of the furniture member 10 and also to each of the first and second torque tube 122, 124 at a forward end of furniture member 10. According to several aspects, the first and second torque tubes 122, 124 are fixed to each other as well as to oppositely disposed tube attachment plates 126, 126'. According to further aspects, the first and second torque tubes 122, 124 can be replaced by a single torque tube. The tube attachment plates 126, 126' are, in turn, connected to each of the first rotation links 84, 84'. As previously noted, the first rotation links 84, 84' are each rotatably connected using first rotational fasteners 86, 86' to individual ones of the first and second L-shaped frame members 80, 82. The coupling bracket 66 is fixed to the first and second torque tubes 122, 124 such that axial displacement of extension shaft 52 forwardly and upwardly displaces each of the first torque tube 122, the second torque tube 124, and the tube attachment plates 126, 126'. This displacement causes forward rotation of each of the first rotation links 84, 84' with respect to the axis 116 defined by first rotational fasteners 86, 86'.

A rear end of the drive housing 48 is connected using a clevis and clevis pin assembly 128 to a motor mount plate 129. Motor mount plate 129 is, in turn, fixed to the rear frame member 121. Use of clevis and clevis pin assembly 128 therefore allows the drive housing 48 to rotate during axial extension or return of extension shaft 52. A first support bracket 130, 130' is rotatably connected to the first rotation links 84, 84' by rotational fasteners 132, 132'. Each of the first support brackets 130, 130' connects to and supports either a first or second support frame 136, 136' (only first support frame 136 is shown for clarity). Each of the first and second support frames 136, 136' is connected to pivot tube 22 and to one of the first or second L-shaped frame members 80, 82.

Figure 20:
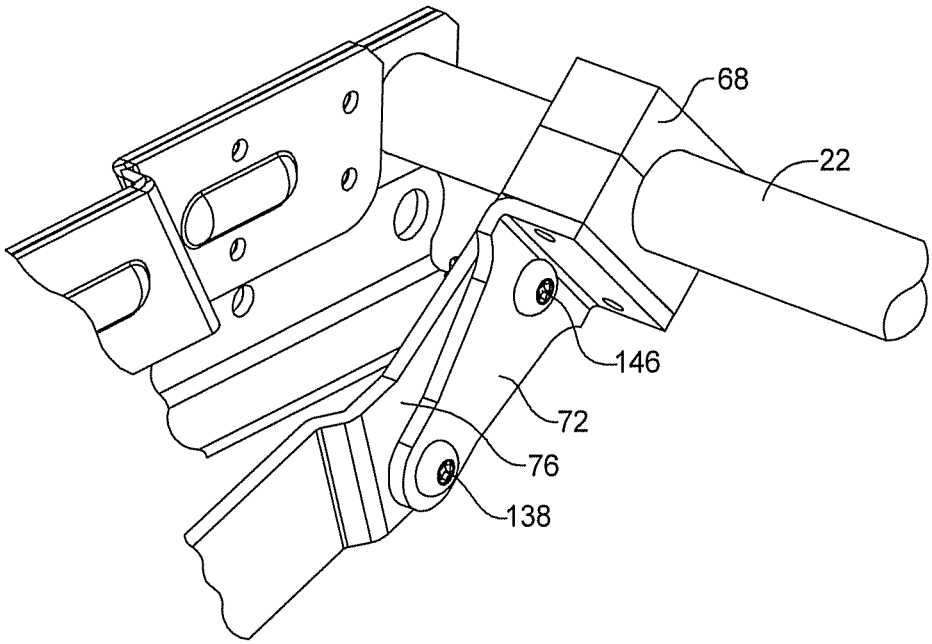
FIG. 20 is the left side perspective view looking rearward of FIG. 19 modified to show installation of a further fastener.

A first fastener 138, 140, if used alone, rotatably connects the first and second journal links 72, 74 to one of the first and second link connecting plates 76, 78 and thereby allows rear tilt mode operation. As will be better described in reference to FIG. 20, a second fastener fixedly connecting the first and second journal links 72, 74 to the first and second link connecting plates 76, 78, when used in conjunction with fasteners 138, 140, prevents rotation of the first and second journal links 72, 74 with respect to the first and second link connecting plates 76, 78, thereby providing for lift mode operation of furniture member 10. A forward lift position (shown) has the pivot tube 22 positioned above the torque tube 122, 124. To provide additional structural support for furniture member 10 for operation in lift mode, the extended support legs 35, 35' can be augmented using first and second support tubes 142, 142' fixed to the extended support legs 35, 35' and also each fixed to one of the first or second L-shaped frame members 80, 82.

Figure 17:
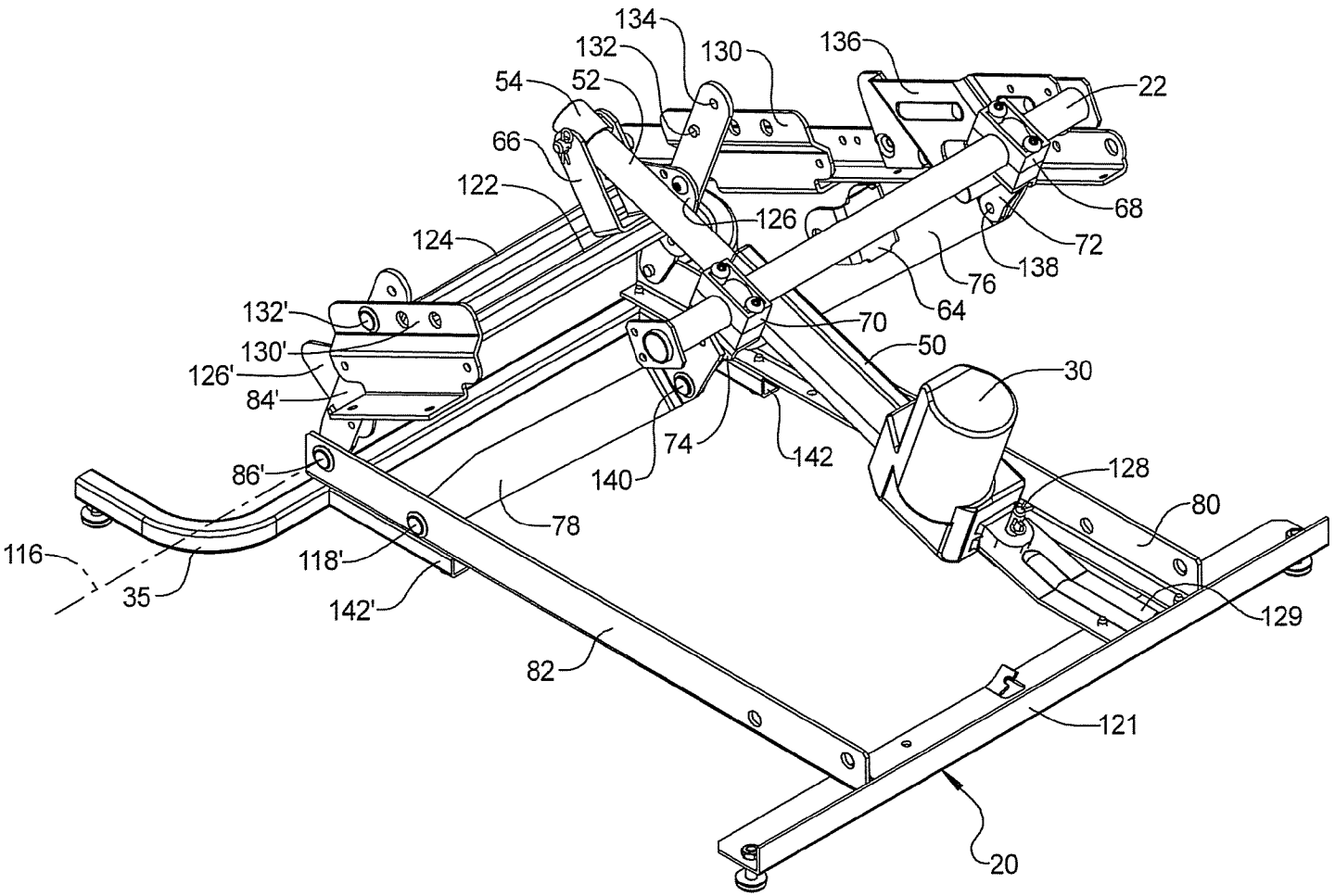
FIG. 17 is a rear perspective view looking forward of a mechanism in the full forward lift position similar to FIG. 12.

Referring to FIG. 18 and again to FIG. 17, the first rotation links 84, 84' are shorter than the first and second link connecting plates 76, 78. Rotation of the first rotation links 84, 84' with respect to common longitudinal axes extending through the first rotational fasteners 86, 86' defines an arc of rotation "J". Rotation of the first and second link connecting plates 76, 78 with respect to common longitudinal axes extending through the third and fourth rotational fasteners 118, 118' defines an arc of rotation "K" having a radial length which is greater than the radial length of arc of rotation "J", thereby providing lift rotation and a lift mode from the same axial extension of extension shaft 52 previously used to provide tilt rotation in the tilt mode.

Figure 18:
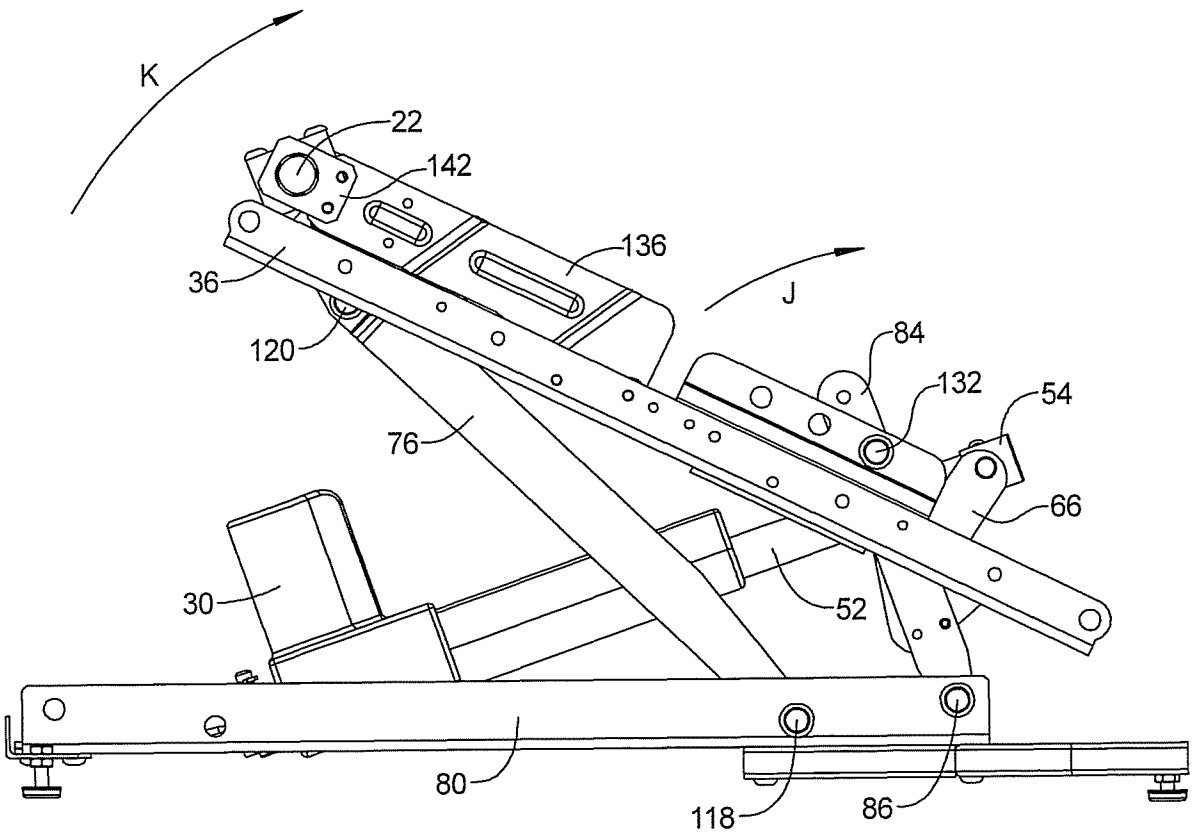
FIG. 18 is a right side elevational view of the mechanism of FIG. 17.

Referring to FIG. 19 and again to FIGS. 17-18, the following discussion of first journal link 72 applies equally to second journal link 74 (not shown in this view). When fastener 138 alone is received in an aperture 144 of first journal link 72 and extends through first link connecting plate 76, fastener 138 permits first journal link 72 to rotate with respect to first link connecting plate 76. This permits first journal bearing 68 and pivot tube 22 to rotate, thereby permitting tilt rotation of furniture member 10 as described in reference to FIGS. 4-5.

Figure 19:
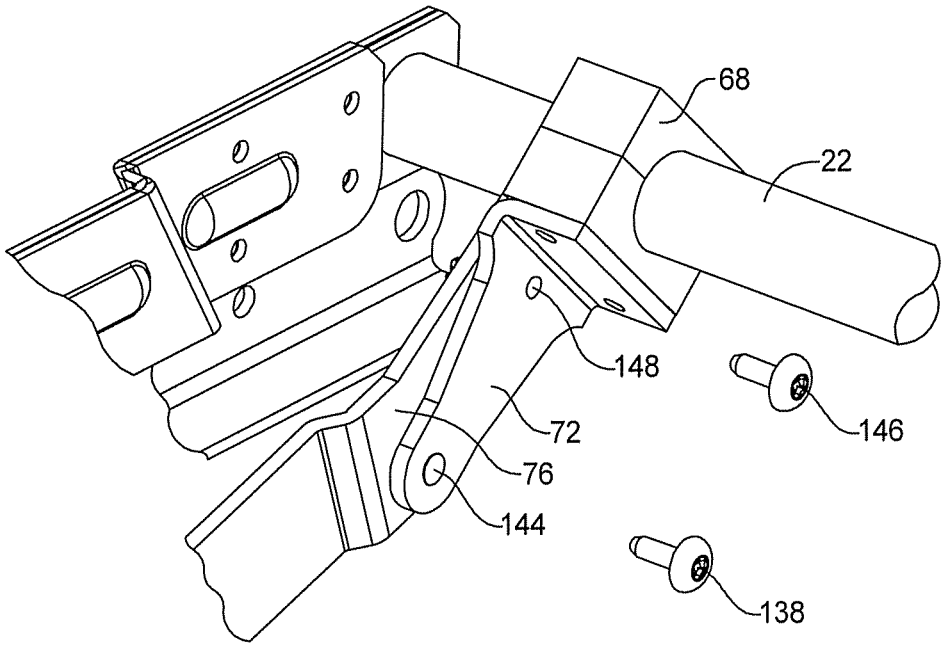
FIG. 19 is a left side perspective view looking rearward of area 19 of FIG. 1.

Referring to FIG. 20 and again to FIGS. 17-19, the following discussion of first journal link 72 applies equally to second journal link 74 (not shown in this view). Fastener 138 is received in aperture 144 of first journal link 72 and extends through first link connecting plate 76. A second fastener 146 is received in an aperture 148 of first journal link 72 and extends through first link connecting plate 76. First and second fasteners 138, 146 together prohibit rotation of first journal link 72 with respect to first link connecting plate 76. This prohibits first journal bearing 68 and pivot tube 22 from axial rotation with respect to first link connecting plate 76, thereby producing lift motion of furniture member 10 as described in reference to FIGS. 12-14. The addition or omission of second fastener 146 is therefore all that is necessary to change first mechanism 47 of furniture member 10 from a tilt mode mechanism to a lift mode mechanism or vice versa.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member, comprising:

a base frame supporting the furniture member on a floor surface;

a first mechanism connected to the base frame including:

a first motor; and a torque tube connected to the first motor and displaced by operation of the first motor; and first and second rotation links individually rotatably connected to the base frame and connected to the torque tube, the first and second rotation links providing for rotation of the furniture member among a rear tilt position, an upright position, and a forward lift position by operating the first motor displacing the torque tube.

2. The furniture member of claim 1, further including a pivot tube connected to the first mechanism and connected by first and second journal bearings to the base frame.

3. The furniture member of claim 2, wherein the first journal bearing includes a first journal link and the second journal bearing includes a second journal link, the first and second journal links individually connected to one of first and second link connecting plates coupling the pivot tube to the base frame.

4. The furniture member of claim 3, wherein the first mechanism provides a lift operation when both a first fastener and a second fastener fixedly connect each of the first and second journal links to the first and second link connecting plates, preventing axial rotation of the pivot tube and forcing rotation of the first and second link connecting plates as the torque tube is displaced by operation of the first motor.

5. The furniture member of claim 3, wherein the first mechanism provides a tilt operation when a first fastener rotatably connects each of the first and second journal links to the first and second link connecting plates, permitting axial rotation and forward displacement of the pivot tube as the torque tube is displaced by operation of the first motor.

6. The furniture member of claim 3, wherein the first and second journal links are shorter than the first and second rotation links such that forward and upward displacement of the torque tube rotates the first and second journal links and forwardly displaces the pivot tube, creating a furniture member rear tilt position having the torque tube elevated above the pivot tube and a rear corner of a base member of the furniture member positioned below a front corner of the base member.

7. The furniture member of claim 1, further including:

a second mechanism supported and rotated by the first mechanism, the second mechanism having a second motor actuated to displace each of a leg rest mechanism and a seat back of the furniture member; and a pivot tube connected to the first mechanism and connected by first and second journal bearings to the base frame.

8. The furniture member of claim 7, wherein a distance of forward displacement of the pivot tube during operation of the first motor is substantially equal to a rearward displacement of a rearmost point of the seat back connected to the base member due to rearward rotation of the furniture member during rotation to the rear tilt position such that a clearance between the rearmost point and a wall proximate to the furniture member is retained between an upright position of the furniture member and the rear tilt position of the furniture member.

9. The furniture member of claim 1, further including:

a motor mount plate fixedly connected to a rear member of the base frame; and a clevis and clevis pin assembly rotatably connecting the first motor to the motor mount plate.

10. A furniture member, comprising:

a base frame supporting the furniture member on a floor surface;

a first mechanism rotatably connected to the base frame including:

a first motor rotatably connected to the base frame;

a torque tube connected to the first motor by an extension tube, the extension tube axially displaced by operation of the first motor; and a pivot tube connected by side frame members to the torque tube and connected by first and second journal bearings to the base frame; and a furniture member base member connected to the side frame members and rotated together with a second mechanism by operation of the first motor among a rear tilt position, an upright position, and a forward lift position by operation of the first motor.

11. The furniture member of claim 10, wherein the first journal bearing includes a first journal link and the second journal bearing includes a second journal link.

12. The furniture member of claim 11, wherein the first and second journal links are individually connected to one of a first and second link connecting plates rotatably connected to the base frame, thereby coupling the pivot tube to the base frame.

13. The furniture member of claim 12, wherein the first mechanism provides a rear tilt operation when a first fastener rotatably connects each of the first and second journal links to the first and second link connecting plates, permitting axial rotation and forward displacement of the pivot tube as the torque tube is displaced by operation of the first motor, a rear tilt position having the pivot tube positioned below the torque tube.

14. The furniture member of claim 12, wherein the first mechanism provides a forward lift operation when both a first fastener and a second fastener fixedly connect each of the first and second journal links to the first and second link connecting plates, preventing axial rotation of the pivot tube and forcing rotation of the first and second link connecting plates as the torque tube is displaced by operation of the first motor, a forward lift position having the pivot tube positioned above the torque tube.

15. The furniture member of claim 10, further including first and second rotation links individually rotatably connected to the base frame and connected to the torque tube, the first and second rotation links together with the first and second journal bearings permitting rotation of the second mechanism to one of the rear tilt position and the forward lift position during operation of the first motor.

16. A furniture member mechanism providing rearward tilt and forward lift operations, comprising:

a base frame supporting the furniture member on a floor surface;

a first mechanism connected to the base frame including:

a first motor movably connected to the base frame;

a torque tube connected to an extension tube displaced by operation of the first motor; and a pivot tube connected to the first mechanism and connected by first and second journal bearings to the base frame;

a second mechanism supported and rotated by the first mechanism, the second mechanism having a second motor; and first and second rotation links individually rotatably connected to the base frame and connected to the torque tube, the first and second rotation links providing for rotation of the second mechanism to one of a rear tilt position having the pivot tube positioned below the torque tube and a forward lift position having the pivot tube positioned above the torque tube by operation of the first motor displacing the torque tube.

17. The furniture member of claim 16, wherein the first and second journal links are individually connected to one of a first and a second link connecting plates connected to the base frame, thereby coupling the pivot tube to the base frame.

18. The furniture member of claim 17, further including a rotational fastener individually rotatably connecting the first and second link connecting plates to the base frame such that the first and a second link connecting plates are rotatable when the first and second rotation links rotate by operation of the first motor.

19. The furniture member of claim 18, wherein the first mechanism provides a forward lift operation when both a first fastener and a second fastener fixedly connect each of the first and second journal links to the first and second link connecting plates, preventing axial rotation of the pivot tube and forcing rotation of the first and second link connecting plates with respect to the rotational fasteners as the torque tube is displaced by operation of the first motor, a forward lift position created when the pivot tube is moved to a position above the torque tube.

20. The furniture member of claim 18, wherein the first mechanism provides a rear tilt operation when only a single fastener rotatably connects each of the first and second journal links to the first and second link connecting plates, the single fastener permitting axial rotation and forward displacement of the pivot tube as the torque tube is displaced during operation of the first motor, a rear tilt position created when the pivot tube is moved to a position below the torque tube.

* * * * *